US005626127A

United States Patent [19]

Maitland et al.

[11] Patent Number: 5,626,127

[45] Date of Patent: May 6, 1997

[54] CLEAN FACE AIR CIRCULATING FIREPLACE

[75] Inventors: Kenneth R. Maitland, Huntington; Robert H. Buzzard, Warren; Mark R. Barnes, Fort Wayne; Brian S. Ohlwine, Zanesville, all of Ind.

[73] Assignee: The Majestic Products Company, Huntington, Ind.

[21] Appl. No.: 394,647

[22] Filed: Feb. 22, 1995

[51] Int. Cl.[6] ..... F24B 1/188

[52] U.S. Cl. ..... 126/523; 126/152 B; 126/529; 126/531; 126/541

[58] Field of Search ..... 126/512, 523, 126/531, 500, 540, 541, 152 R, 152 A, 152 B, 524, 529, 92 R, 92 AC; 431/125, 110, 112

[56] References Cited

U.S. PATENT DOCUMENTS 4,085,727 4/1978 Gillpatrick .
4,154,214 5/1979 Owens .
4,240,401 12/1980 Chesnut ..... 126/522
4,434,783 3/1984 O'Gorman ..... 126/531
4,512,329 4/1985 Sweet .
5,000,162 3/1991 Shimek .

*Primary Examiner*—James C. Yeung
*Attorney, Agent, or Firm*—Baker & Daniels

[57] ABSTRACT

A fireplace including a heat exchanger beneath the combustion chamber floor. The front panel or surround of the fireplace housing includes a central opening which accesses the combustion chamber. Room air inlets and outlets, which are ducted to the heat exchanger, are horizontally arranged in a duct manifold that is positioned above the front panel opening. By positioning the room air inlets and outlets within the front panel opening rather than in the surround, the entire surround can be faced with marble, brick or other decorative material without having to provide a break therein for the ingress and egress of room air. A fan within the heat exchanger circulates room air in a flow path from the room being heated into the duct manifold inlets, through a first duct and into the heat exchanger, from the heat exchanger and through a second duct, and out through the duct manifold outlets. The fireplace also includes a raiseable hearth overlaying an opening accessing the heat exchanger fan. The fuel grate of the fireplace includes a connector connecting with the hearth that allows the grate to be utilized as a handle to raise the hearth.

21 Claims, 4 Drawing Sheets

CLEAN FACE AIR CIRCULATING FIREPLACE

BACKGROUND OF THE INVENTION

This invention relates to a combustion apparatus such as a fireplace, and, in particular, to a fireplace having a circulation passageway within the fireplace through which room air passes and is heated prior to being exhausted at a higher temperature to the room being heated.

Known in the art are a multitude of different types of combustion apparatus, including fireplaces such as free-standing models and zero clearance models. These fireplaces commonly include housings or shells that surround the combustion chambers or fireboxes where combustion of fuel occurs. The walls of the housing are typically constructed in spaced relationship with some or all of the walls of the combustion chamber, including the bottom wall and top wall which form the floor and ceiling of the combustion chamber. The resulting space or plenums provided between the combustion chamber and housing permits the formation of passageways suitable to circulate air. Existing fireplaces have used these passageways to circulate air to serve a number of nonexclusive purposes, including the transfer of heat to room air which is inlet into these passageways. The inlet room air is discharged from the fireplace at a higher temperature to heat the room in which the fireplace unit is installed.

The forward, bottom portion of the combustion chamber often becomes very hot during fireplace operation and therefore serves as a valuable source of heat to be transferred to circulating room air. To utilize this heat, many conventional fireplaces use a C-shaped room air circulation passageway which extends around the bottom, rear, and top of the combustion chamber. One shortcoming with this design results from the way room air reaches these passageways. Apertured or louvered grills disposed along the bottom and top portions of the front wall of the fireplace and in communication with the circulation passageway respectively serve as inlets and outlets for the room air being heated. These plainly visible louvers are generally unsightly and detract from the overall appearance of the fireplace. Moreover, the presence of these louvers prevents the front of the fireplace around the opening to the combustion chamber from being covered with an aesthetically pleasing brick or marble facade. Another disadvantage to such these passageways is the potential expense of this ductwork extending completely around the fireplace.

Fireplaces attempting to reduce the unsightliness of a louvered fireplace face have met with limited success. For example, one existing fireplace utilizes a heat exchanger below the fireplace floor into which room air inlets and outlets through a slot disposed in the front face of the fireplace adjacent to the floor of the room. A circulating fan draws room air through a portion of the slot, circulates this introduced room air below the combustion chamber to be warmed, and then exhausts the now heated room air back to the room through different portions of the slot. Because this room air inlet/outlet slot is spaced below the opening into the combustion chamber, it may be more visible to a casual observer. In addition, this positioning of the slot prevents a slab of marble, for example, from covering the entire fireplace face between the room floor and the combustion chamber opening, as such marble facing would block the slot. Still another shortcoming of this fireplace is that an access panel allowing access to the fan within the heat exchanger is positioned in the front face of the fireplace and detracts from a desired continuous fireplace face.

Additional heat exchangers which attempt to capitalize upon the available heat at the bottom, forward portion of the fireplace combustion chamber are disclosed in U.S. Pat. Nos. 4,085,727 and 4,154,214. These designs are undesirable from an aesthetics standpoint as they respectively utilize a louvered front panel and an external blower. Still other heat exchangers, such as those disclosed in U.S. Pat. Nos. 4,512,329 and 5,000,162, utilize ducts for circulating room air which may be visibly positioned on top of the fireplace hearth and which thereby detract from the overall aesthetics of the fireplace.

Thus, it is desirable to provide a fireplace which has a clean face while providing inlets and outlets to a room air circulating passageway used as a heat exchanger within the fireplace. It is further desirable to provide a fireplace which allows access to blowers within a heat exchanger below the combustion chamber without detracting from the overall appearance of the fireplace face.

SUMMARY OF THE INVENTION

The present invention provides a fireplace with a room air circulating passageway having inlet openings and outlet openings positioned within the opening to the fireplace combustion chamber. These inlets and outlets advantageously do not interrupt the clean face of the fireplace and do not hinder the bricking or covering of the fireplace face. The inventive fireplace also allows for ready access to fans provided within the room air circulating passageway by providing an access panel in the combustion chamber floor. The access panel does not interrupt the fireplace face and is readily accessible. The invention further provides a firebrick combustion chamber hearth which is removable via a connection with a fuel grate, thereby allowing ready access to the access panel.

In one form thereof, the present invention provides a fireplace including a combustion chamber whereat fuel is combusted and products of combustion are created. The combustion chamber includes an opening through which combustion air is introduced. The fireplace also includes a flue positioned for exhausting the products of combustion from the combustion chamber, and a housing comprising a front panel including a frontal surface facing toward the room in which the fireplace is installed. The front panel has a combustion chamber access opening. The fireplace includes a closure device positioned within the front panel access opening and openable to access the combustion chamber, and a duct manifold including a plurality of horizontally aligned openings through which room air passes during heat exchanging circulation. The plurality of duct manifold openings include a first opening and a second opening, and the duct manifold openings are in air flow communication with the front panel access opening. The fireplace also includes a heat exchanger positioned beneath the combustion chamber floor, and the heat exchanger includes at least one fan for circulating air therethrough. The fireplace includes a first duct providing flow communication between an inlet of the heat exchanger and the duct manifold first opening for the introduction of air from the room being heated, and a second duct providing flow communication between an outlet of the heat exchanger and the duct manifold second opening to exhaust warmed room air to the room being heated. During fireplace operation, the fan circulates room air in a flow path from the room being heated into the duct manifold first opening, through the first duct, through the heat exchanger, through the second duct, and out through the duct manifold second opening.

In another form thereof, the fireplace of the present invention includes a combustion chamber whereat the fuel is combusted and products of combustion are created. The combustion chamber has an opening through which combustion air is introduced. The combustion chamber also has a floor of which at least a portion is raiseable. The fireplace also includes a flue positioned for exhausting the products of combustion from the combustion chamber, a grate for supporting the fuel, and at least one connector connecting the grate and the raiseable floor portion such that application of an upward force to the grate raises the raiseable floor portion.

One advantage of the present invention is that room air can be inlet and outlet to a circulation passageway for drawing heat from the combustion chamber without requiring any louvers or openings within the fireplace face which detract from the aesthetics of the fireplace.

Another advantage of the present invention is that access to the room air circulating fans within a fireplace heat exchanger is facilitated by the connection of the fireplace grate with a removable combustion chamber floor.

Still another advantage of the present invention is that the access panel to the room air circulating fans within a fireplace heat exchanger is not provided on the fireplace face and therefore does not detract from the appearance of the fireplace face.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
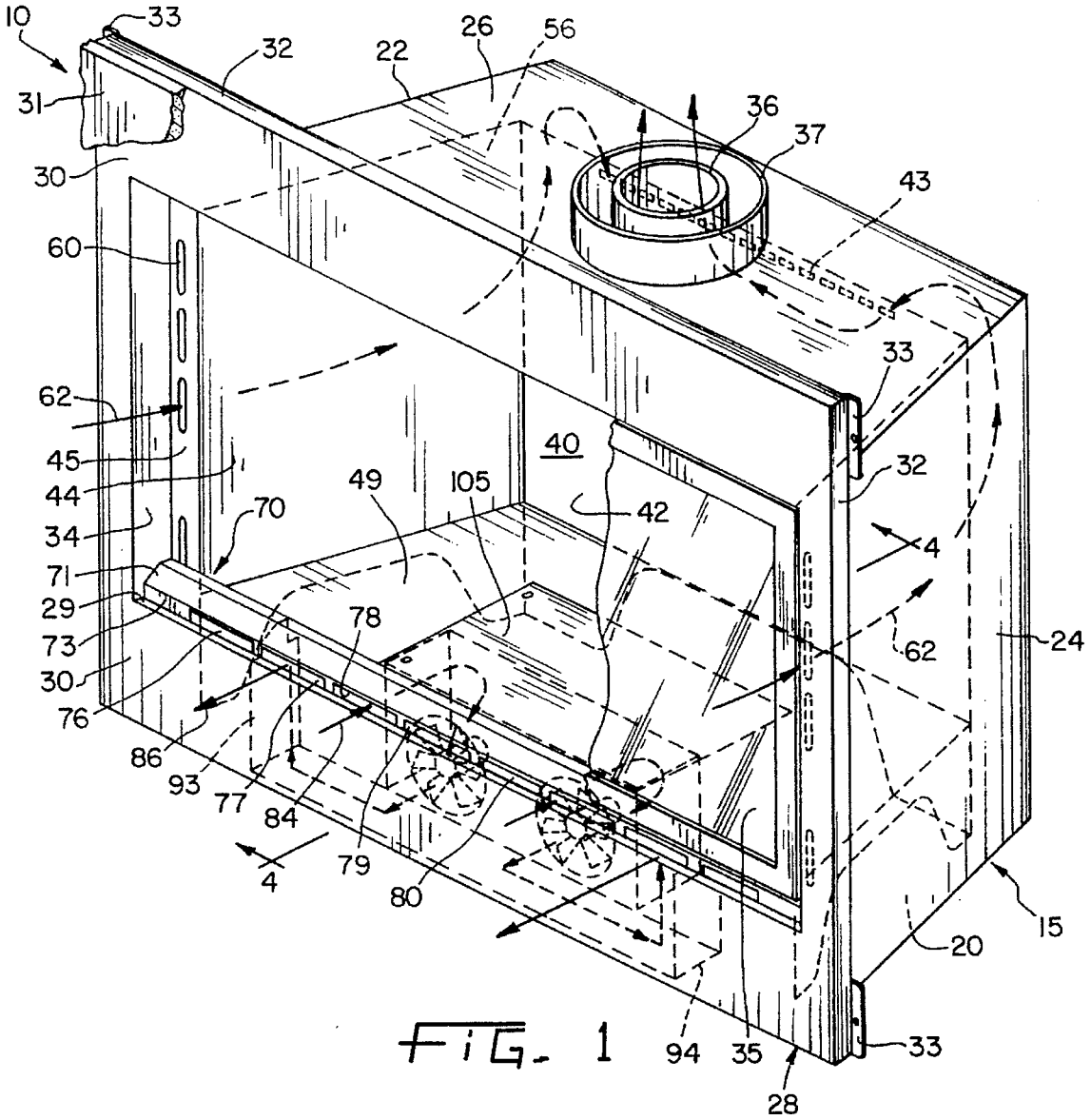
FIG. 1 is a fragmentary perspective view of an embodiment of the present invention showing a zero clearance fireplace with the glass paneled enclosure of the combustion chamber partially shown, and with the combustion chamber firebrick floor and fuel grate removed for illustration purposes.

Corresponding reference characters indicate corresponding parts throughout the several views. Although the drawings represent an embodiment of the invention, the drawings are not necessarily to scale and certain features may be exaggerated in order to better illustrate and explain the present invention.

DESCRIPTION OF THE PREFERRED EMBODIMENT

The embodiment disclosed below is not intended to be exhaustive or limit the invention to the precise form disclosed in the following detailed description. Rather, the embodiment is chosen and described so that others skilled in the art may utilize its teachings.

Figure 2:
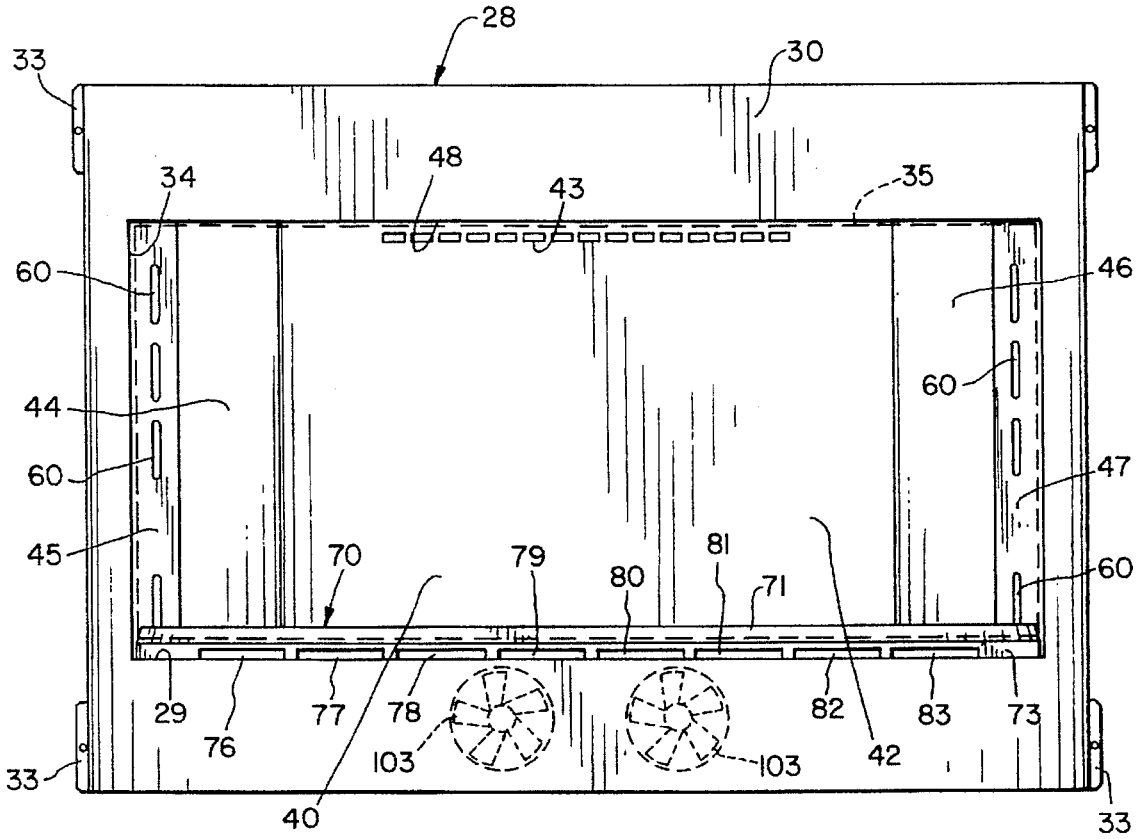
FIG. 2 is a front view of the fireplace of FIG. 1 with the glass paneled doors abstractly shown in shadow.
Figure 3:
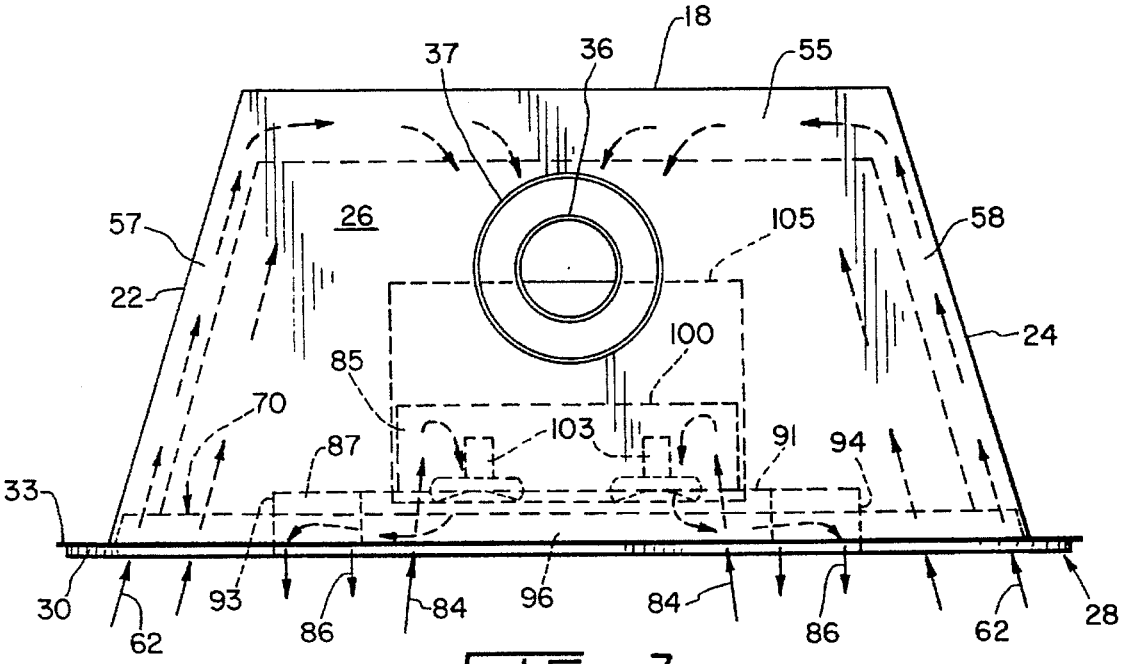
FIG. 3 is a top view of the fireplace of FIG. 1 showing the room air flow paths.

Referring now to FIGS. 1–3, there are respectively shown a fragmentary perspective view, a front elevational view, and a top view of a clean face air circulating fireplace of the present invention. While the fireplace is shown and further explained herein with reference to a zero clearance, wood-burning fireplace product, the described embodiment is merely illustrative of one type of beneficial application of the present invention. For example, present invention may also be advantageously utilized with other fireplace units, for instance, gas appliances, where the heat exchanging capabilities coupled with the louverless, clean face appearance of the unit is desirable. In addition, the particular overall shape and construction of the zero clearance fireplace shown in not material to the present invention, and those of skill in the art will appreciate that an assortment of modifications to the fireplace can be provided while still utilizing the teachings of the present invention.

The zero clearance fireplace, generally designated 10, includes an outer housing or shell, generally designated 15, sized and shaped to closely fit within a fireplace chase provided in a building. Housing 15 is formed in part by interconnecting steel plates at their edges to provide rear surface or wall 18, bottom wall 20, opposing side walls 22, 24, and top wall 26. The forward or frontal portion of outer housing 15 is formed by front panel or surround 28. Surround 28 is constructed from steel and is generally rectangular in shape with rearwardly extending flanges 32 formed along its four edges. Laterally projecting nailing flanges 33 allow surround 28 to be secured to the building studs or structure defining the chase into which fireplace 10 is installed. Frontal surface 30 of surround 28 is planar and is unbroken except for rectangular opening 34, which is formed in the central portion of surround 28 and allows access to the fireplace combustion chamber. When installed, surround 28 can be entirely covered, for example, by bricks or a marble facade, to improve the room aesthetics. The forward edges of bottom wall 20, opposing side walls 22, 24, and top wall 26 are fastened to the bottom edge flange 32 and the rearward face of surround 28.

As partially shown in FIG. 1, and as shown abstractly in dashed lines in FIG. 2, central opening 34 in surround 28 is substantially covered with a standard set of glass doors 35 which are hingedly mounted in a well known manner. Alternate openable closure devices known in the art may also be employed. Doors 35 are mounted to shelf 29 so as to be coplanar with frontal surface 30. Shelf 29 is provided in surround 28 as a result of the provision of opening 34. The depth of shelf 29 is increased by providing lip 31 (See FIG. 4) extending rearwardly from surround 28.

Figure 5:
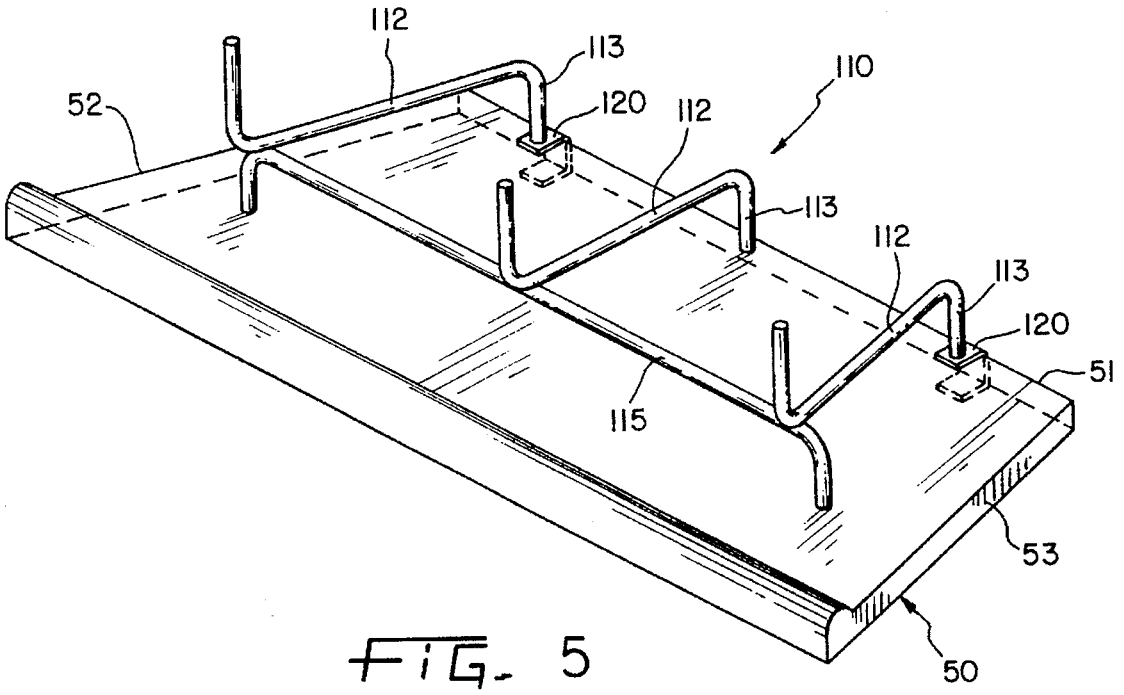
FIG. 5 is a front perspective view of the combustion chamber firebrick floor and connected grate of the present invention.
Figure 6:
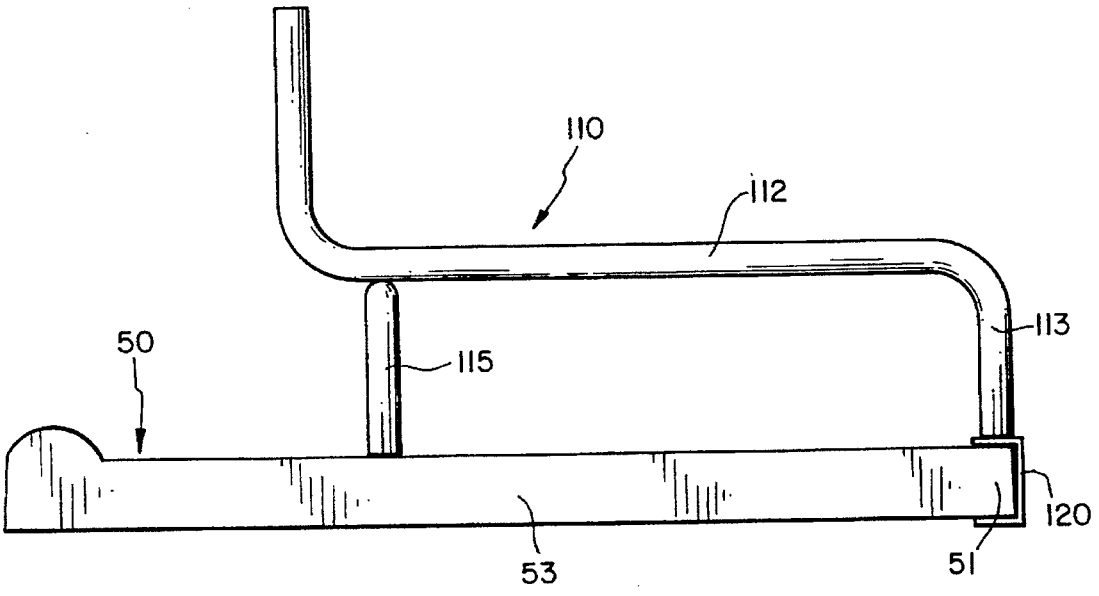
FIG. 6 is a right side view of the firebrick floor and grate of FIG. 5.
Figure 7:
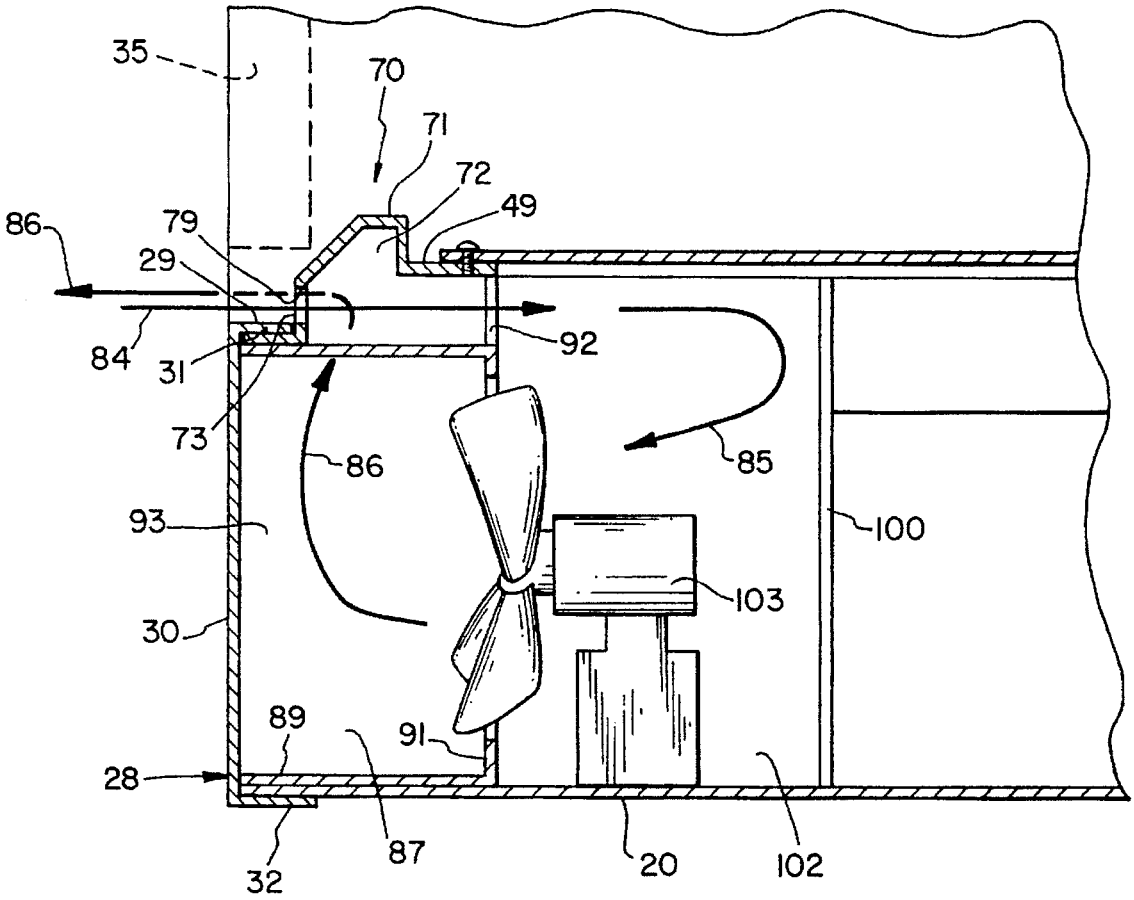
FIG. 7 is an enlarged view of a portion of FIG. 4.

The fireplace combustion chamber 40 within housing 15 is defined in part by rear wall 42, side walls 44, 46, and top wall 48, which are each interiorly lined with a refractory material or firebricks to withstand the high temperatures experienced during operation. Integrally formed with the metal sub-wall at the forward edges of side walls 44, 46 are stepped wall regions 45, 47, which extend into surround opening 34 and are connected to surround 28. Combustion chamber 40 is further defined by its hearth. In FIGS. 1–4, only the sheet metal sub-flooring or hearth pan 49 of the combustion chamber hearth is shown. The firebrick hearth or floor 50, which is supported by and covers the portion of hearth pan 49 rearward of upper duct manifold 70 during use, is shown in FIGS. 5 and 6 removed from the balance of fireplace 10. As described more fully below, floor 50 can be lifted and removed to permit access to the heat exchanger fans 103. Although combustion air is introduced or enters into combustion chamber 40 from the room in which fireplace 10 is installed through opening 34 in the shown embodiment, combustion air could alternatively be provided through other openings or inlets, for example openings in the side walls of combustion chamber 40 connected by conduits to either room air or an outside air source.

In the shown embodiment, the walls of combustion chamber 40 are spaced from housing 15 to define bottom plenum 54, rear plenum 55, top plenum 56, and side plenums 57, 58. Plenums 54–58 are linked to form channels or passageways through which room air may be circulated to cool housing 15. Vertically elongate and aligned inlets 60 provided in stepped wall regions 45, 47 allow room air to be drawn into side plenums 57, 58. Inlets 60 are rearwardly recessed from frontal surface 30 of surround 28 and are positioned behind the closed doors of closure device 35. When doors 35 are shut during operation, room air may reach inlets 60 by passing between surround 28 and the lateral and top edges of doors 35. It will be appreciated that this partial blockage does not interfere with a proper operation of the fireplace as when the doors are closed the fire within combustion chamber 40 will not burn as hot and less cooling air will be required to be circulated to keep housing 15 cool. Inlets 60 could also be positioned laterally of doors 35 so as to not be blocked thereby. However, to a person in the room being heated, these inlets would be more readily visible as a vertical border of the doors and this visibility would slightly detract from the clean face appearance of fireplace 10.

As indicated by arrows 62 shown in FIG. 1, a portion of the cooling room air drawn into side plenums 57, 58 proceeds rearwardly into rear plenum 55, is drawn into combustion chamber 40 through a row of holes 43 in the upper region of combustion chamber rear wall 42, and passes with the high temperature products of combustion into the inner pipe 36 of the flue stack which upwardly projects from combustion chamber 40 through an aperture in housing top wall 26. The annular region between outer pipe 37 and inner pipe 36 of the flue stack opens into top plenum 56. A portion of the circulating room air which is originally drawn into side plenums 57, 58 is drawn from either the side or rear plenums into top plenum 56 to cool the housing top wall 26. The cooling air within top plenum 56 proceeds to be exhausted through the annular region of the flue stack. The flue stack can be installed as is conventional in flow communication with a chimney stack of the building to allow the products of combustion and the cooling room air produced within fireplace 10 during operation to be exhausted to the outside atmosphere. The provision of holes 43 achieving flow communication between the cooling air plenums and the combustion chamber assists in ensuring that a draft of cooling air through the cooling air plenums sufficient to adequately cool housing 15 is maintained.

With reference now to FIGS. 1–4, positioned substantially underneath fireplace hearth 50 during operation is a heat exchanger which intakes room air and exhausts the room air after being warmed by the combustion occurring within the combustion chamber 40. The heat exchanger utilizes an upper duct manifold, generally designated 70, which extends the entire width of combustion chamber 40. Upper duct manifold 70 includes a compartmentalized interior chamber 72 which is bounded on top by a multi-angled forward extension 71 of hearth pan 49. Along forward face 73, which is disposed within opening 34 in surround 28, recessed from and oriented parallel to surround frontal surface 30, forward extension 71 is provided with a set of eight horizontally aligned and horizontally elongate openings 76, 77, 78, 79, 80, 81, 82 and 83 which open into interior chamber 72. Additional or fewer apertures or louvers could be provided within the scope of the invention. Openings 76–83 account for the majority of the surface area of forward face 73.

Figure 4:
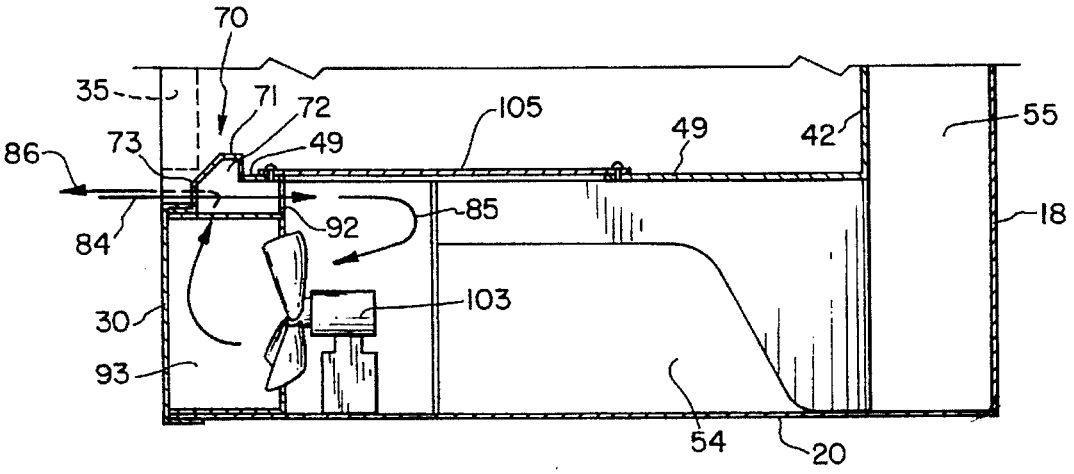
FIG. 4 is a cross-sectional side view, taken along line 4—4 of FIG. 1, of a bottom portion of the fireplace illustrating the heat exchanger air flow path and the access panel positioning.

As best shown in FIGS. 3 and 4, a lower duct 87 is arranged directly below and extends rearwardly from the central portion of upper duct manifold 70. Duct 87 is defined by the rear surface of surround 28 and by a closure element having a base flange 89 mounted to the housing bottom wall 20. The closure element further includes an upstanding rear flange 91, a pair of vertical side flanges 93, 94 (see FIG. 1) which extend forward to surround 28 from the lateral edges of rear flange 91, and an upper horizontal flange 96. Side flanges 93, 94 are laterally positioned between openings 76, 77 and openings 82, 83, respectively, and the upper edges of side flanges 93, 94 are contoured to fit with multi-angled forward extension 71 and thereby form an air barrier within interior chamber 72 between openings 76 and 77 and openings 82 and 83. Upper flange 96 laterally extends below openings 78–81, leaving spaces between horizontal flange 96 and both side flanges 93, 94 through which air can be exhausted from lower duct 87. Rear flange 91 upwardly extends to the underside of hearth pan 49 laterally of upper flange 96. The central region of rear flange 91 ends at upper flange 96, leaving a slot-shaped opening 92 between hearth pan 49 and rear flange 91 through which inlet room air may flow.

Baffle 100 is located behind lower duct 87 and is fastened to housing bottom wall 20. Baffle 100 is C-shaped in horizontal cross section and cooperates with rear flange 91, housing bottom wall 20, and the underside of access panel 105 to define compartment 102. Mounted within compartment 102 are a pair of conventional fans or blowers 103 which serve to circulate room air through the heat exchanger. Fans 103 are shown abstractly and without an electrical connection to a power source as such is well known in the art. Fans 103 are positioned behind circular openings provided in rear flange 91 that allow communication between chamber 102 and lower duct 87. Access panel 105 covers an access opening in hearth pan 49 and may be removably fastened thereto in a conventional manner. Access panel 105 is removable to allow access to fans 103 for purposes of fan maintenance or repair. Access panel 105 and baffle 100 also serve as heat shields protective of fans 103.

Because forward face 73 carrying openings 76–83 is disposed within opening 34 defined in front surround 28, the entire front face of surround 28 can be faced with brick, marble or any other decorative surface 31. This provides a clean, aesthetically pleasing face to the fireplace. The position of openings 76–83 for circulation of room air are disposed in a recessed area above the lower shelf portion 29 of opening 34 between shelf 29 and the bottom edges of the doors. This provides good visual concealment of the openings without interfering with the flow of air to and from the heat exchanger.

During fireplace operation, in order to cool the bottom, forward portion of the combustion chamber and transfer the heat energy into the room being heated, heat exchanger fans 103 are activated and serve to draw cooler room air into interior chamber 72 of upper duct manifold 70 through inlets 78–81 as represented by arrows 84. The room air proceeds to pass rearwardly through this duct region over the top surface of upper flange 96, passes through slot-shaped opening 92, and enters compartment 102. During this flow, the room air passes along the underside of hearth pan 49 so as to be warmed thereby. As represented by arrow 85, circulating fans 103 proceed to redirect and exhaust the now warmed room air from chamber 102 through the openings provided in rear flange 91 and into lower duct 87. As represented by arrows 86, the air introduced in duct 87 proceeds to pass laterally toward side flanges 93, 94, upwardly through the spaces provided between vertical side flanges 93, 94 and upper flange 96, and the warmed room is then exhausted outwardly through outlets 77, 82 into the room being heated. It will be appreciated that while interior chamber 72 of upper duct manifold 70 need not be compartmentalized between openings 77, 78 and 81, 82 in order function as described, additional ducting could be provided within the scope of the invention. In addition, alternate air flow paths which utilize openings 76–83 in a fashion other than the inlet and outlet functions described above and below are possible within the scope of the present invention. Moreover, the openings for the heat exchanger could possibly be mounted along the sides or top of the enclosure doors, but such is not preferred due to the need to introduce additional ducting.

The region of interior chamber 72 into which openings 76 and 83 open is unbounded at its lower side and is in flow communication with bottom plenum 54. Room air drawn through inlet openings 76 and 83 during operation initially serves to cool the housing bottom wall 20 and then passes into rear plenum 55 or side plenums 57 and 58, from where the air is exhausted in a manner described above.

Referring now to FIGS. 5 and 6, the removable firebrick hearth or floor 50 and grate 110 are shown operatively linked together in a front perspective view and a side view. To permit a user to reach access panel 105 which covers the central opening in hearth pan 49, the portion of hearth 50 covering access panel 105 is at least raiseable and is preferably removable. In the shown embodiment, the entire firebrick hearth 50 which sets on hearth pan 49 is removable, and the rear edge 51 and side edges 52, 53 of hearth 50 abut the refractory lining of the combustion chamber rear wall 42 and side walls 44, 46, respectively.

Grate 110 is made of tubular steel and is shown including three horizontal tubular rods 112 which support the fuel being combusted. Rods 112 rearwardly terminate with downwardly extending legs 113 which are supported by hearth 50. The forward portions or rods 112 are attached to rod 115, which includes downwardly extending legs supported by but not attached to hearth 50.

As best shown in FIG. 6, securing grate 110 to hearth 50 are a pair of connectors 120 which are attached to the lateral most legs 113 of grate 110. Connectors 120 are shown as C-shaped brackets which closely conform to and fit over the rear edge 51 of hearth 50. While a preferred construction of connector 120 is shown herein, alternately constructed and functioning connecting devices can be employed within the scope of the invention, and therefore as used herein connector broadly references any device utilized to connect grate 110 to hearth 50. Connectors 120 allow grate 110 to be utilized as a handle for lifting hearth 50, as lifting grate 110 achieves a raising of hearth 50. This connection eliminates the need for tools to be used to pry hearth 50 from its installed location, and this is beneficial as such prying could be damaging to the firebrick material. It will be appreciated that the actual configuration of grate 110 is not essential to the invention, as differently shaped grates may utilize the teachings of the invention so as to be connectable to firebrick hearth 50 to serve as lifting handles.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fireplace for a room to be heated comprising:

a combustion chamber whereat fuel is combusted and products of combustion are created, said combustion chamber comprising an opening through which combustion air is introduced, said combustion chamber further comprising a floor;

a flue positioned for exhausting the products of combustion from said combustion chamber;

a housing comprising a front panel including a frontal surface facing toward the room, said front panel having a combustion chamber access opening;

a transparent door positioned within said front panel access opening and openable to access said combustion chamber;

a duct manifold including a plurality of horizontally aligned openings through which room air passes during heat exchanging circulation, said plurality of duct manifold openings including a first room air intake opening and a second room air discharge opening, said duct manifold openings disposed in said front panel access opening;

a heat exchanger positioned beneath said combustion chamber floor, said heat exchanger including at least one fan for circulating air therethrough;

a first duct providing flow communication between an inlet of said heat exchanger and said duct manifold first opening for the introduction of air from the room being heated; and a second duct providing flow communication between an outlet of said heat exchanger and said duct manifold second opening to exhaust warmed room air to the room being heated;

whereby during fireplace operation said fan circulates room air in a flow path from the room being heated into said duct manifold first opening, through said first duct, through said heat exchanger, through said second duct, and out through said duct manifold second opening.

2. The fireplace of claim 1 wherein said duct manifold openings are positioned above a bottom edge of said front panel opening.

3. The fireplace of claim 2 wherein said duct manifold openings are recessed from said front panel frontal surface and positioned at a height below a bottom edge of said door.

4. The fireplace of claim 1 wherein said combustion chamber floor comprises a hearth pan and a raiseable hearth overlaying said hearth pan, and wherein said duct manifold comprises a forward extension of said hearth pan.

5. The fireplace of claim 1 wherein said door comprises hinged doors.

6. A fireplace for a room to be heated comprising:

a combustion chamber whereat fuel is combusted and products of combustion are created, said combustion chamber comprising an opening through which combustion air is introduced, said combustion chamber further comprising a floor;

a flue positioned for exhausting the products of combustion from said combustion chamber;

a housing comprising a front panel including a frontal surface facing toward the room, said front panel having a combustion chamber access opening;

a transparent door positioned within said front panel access opening, and openable to access said combustion chamber;

a duct manifold including a plurality of horizontally aligned openings through which room air passes during heat exchanging circulation, said plurality of duct manifold openings including a first room air intake opening and a second room air discharge opening, said duct manifold openings disposed in said front panel access opening, said first air intake opening being generally centrally disposed along the length of said duct manifold, said second air discharge opening being laterally disposed of said first opening;

a heat exchanger positioned beneath said combustion chamber floor, said heat exchanger including at least one fan for circulating air therethrough;

a first duct providing flow communication between the inlet of said heat exchanger and said duct manifold first opening for the introduction of air from the room being heated, said first duct comprising an interior chamber of said duct manifold rearwardly of said first opening, said first duct being downwardly bounded by a divider flange laterally extending below said first opening; and a second duct providing flow communication between an outlet of said heat exchanger and said duct manifold second opening to exhaust warmed room air to the room being heated, said second duct being disposed generally beneath said first duct and being upwardly bounded by said divider flange, rearwardly bounded by a rear flange, and laterally bounded by a side flange spaced from a lateral edge of said divider flange, said second duct further comprising an interior chamber of said duct manifold rearwardly of said second opening, said heat exchanger comprising an interior compartment positioned rearwardly of said second duct and in communication with said second duct through apertures in said rear flange;

whereby during fireplace operation said fan circulates room air in a flow path from the room being heated into said duct manifold first opening, through said first duct, through said heat exchanger, through said second duct, and out through said duct manifold second opening.

7. A fireplace for a room to be heated comprising:

a combustion chamber whereat fuel is combusted and products of combustion are created, said combustion chamber comprising an opening through which combustion air is introduced, said combustion chamber further comprising a floor, said combustion chamber floor comprising a hearth pan and a raiseable hearth overlaying said hearth pan;

a flue positioned for exhausting the products of combustion from said combustion chamber;

a housing comprising a front panel including a front surface facing toward the room, said front panel having a combustion chamber access opening;

a transparent door positioned within said front panel access opening and openable to access a combustion chamber;

a duct manifold including a plurality of horizontally aligned openings through which warm air passes during heat exchanging circulation, said plurality of duct manifold openings including a first room air intake opening and a second room air discharge opening, said duct manifold openings disposed in said front panel access opening;

a heat exchanger positioned beneath said combustion chamber floor, said heat exchanger including at least one fan for circulating air therethrough, said hearth pan comprising a service opening located over said heat exchanger allowing access to said fan;

a first duct providing flow communication between an inlet of said heat exchanger and said duct manifold first opening for the introduction of air from the room being heated; and a second duct providing flow communication between an outlet of said heat exchanger and said duct manifold second opening to exhaust warmed room air to the room being heated;

whereby during fireplace operation said fan circulates room air in a flow path from the room being heated into said duct manifold first opening, through said first duct, through said heat exchanger, through said second duct, and out through said duct manifold second opening.

8. The fireplace of claim 7 further comprising an access panel attachable to said hearth pan and covering said service opening.

9. The fireplace of claim 7 further comprising a grate for supporting the fuel and at least one connector connecting said grate and said raiseable hearth such that application of an upward force to said grate raises said hearth.

10. The fireplace of claim 9 wherein said hearth is removable without the use of tools from said combustion chamber.

11. A fireplace for a room to be heated comprising:

a combustion chamber whereat fuel is combusted and products of combustion are created, said combustion chamber comprising an opening through which combustion air is introduced, said combustion chamber further comprising a floor;

a flue positioned for exhausting the products of combustion from said combustion chamber;

a housing comprising a front panel including a frontal surface facing toward the room, said front panel having a combustion chamber access opening, said housing comprising a bottom wall disposed in spaced apart relationship with said combustion chamber floor to form a lower plenum therebetween;

a transparent door positioned within said front panel access opening and openable to access said combustion chamber;

a duct manifold including a plurality of horizontally aligned openings through which air passes during heat exchanging circulation, said plurality of duct manifold openings including a first room air intake opening and a second room air discharge opening, said duct manifold openings disposed in said front panel access opening;

a heat exchanger positioned beneath said combustion chamber floor, said heat exchanger including at least one fan for circulating air therethrough;

a first duct providing flow communication between an inlet of said heat exchanger and said duct manifold first opening for the introduction of room air from the room being heated;

a second duct providing flow communication between an outlet of said heat exchanger and said duct manifold second opening to exhaust warmed room air to the room being heated; and means for exhausting air within said lower plenum externally of said fireplace, said plurality of duct manifold openings including a third opening in communication with said lower plenum to permit introduction of room air to said lower plenum;

whereby during fireplace operation said fan circulates room air in a flow path from the room being heated into said duct manifold first opening, through said first duct, through said heat exchanger, through said second duct, and out through said duct manifold second opening.

12. The fireplace of claim 11 wherein said combustion chamber comprises opposite side walls, wherein said housing comprises opposite side walls in spaced apart relationship with said opposite side walls of said combustion chamber to form a pair of side plenums therebetween, wherein a forward portion of each combustion chamber side wall includes a stepped region having a plurality of vertically elongate apertures in communication with one of said side plenums to permit introduction of room air thereto, and wherein said fireplace further comprises means for exhausting air within said side plenums externally of the fireplace.

13. The fireplace of claim 12 wherein said means for exhausting air within said side plenums comprises a rear plenum, formed behind said combustion chamber rear wall and in flow communication with said side plenums, and a plurality of holes through an upper portion of said combustion chamber rear wall, whereby during use air in said side plenums is drawn through said rear plenum and through said holes into said combustion chamber and passes with said products of combustion through said flue.

14. A fireplace for a room to be heated comprising:

a combustion chamber whereat fuel is combusted and products of combustion are created, said combustion chamber comprising an opening through which combustion air is introduced, said combustion chamber further comprising a floor;

a flue positioned for exhausting the products of combustion from said combustion chamber;

a housing comprising a front panel including a frontal surface facing toward the room, said front panel having a combustion chamber access opening;

a transparent door positioned within said front panel access opening and openable to access said combustion chamber;

a heat exchanger positioned beneath said combustion chamber floor, said heat exchanger including at least one fan for circulating air therethrough;

duct means for introducing room air into said heat exchanger, said room air introducing duct means comprising at least one inlet opening;

duct means for exhausting warmed room air from said heat exchanger into the room, said warmed room air exhausting duct means comprising at least one outlet opening;

wherein said at least one inlet opening and said at least one outlet opening are horizontally aligned and positioned above a bottom edge of said front panel opening.

15. The fireplace of claim 14 wherein said at least one inlet opening and said at least one outlet opening are recessed from said front panel frontal surface.

16. The fireplace of claim 14 wherein said at least one inlet opening is horizontally elongate and centrally disposed along a width of said combustion chamber, and wherein said at least one outlet opening comprises a pair of horizontally elongate outlet openings laterally flanking said at least one inlet opening.

17. A fireplace for a room to be heated comprising:

a combustion chamber whereat fuel is combusted and products of combustion are created, said combustion chamber comprising an opening through which combustion air is introduced, said combustion chamber further comprising a floor;

a flue positioned for exhausting the products of combustion from said combustion chamber;

a housing comprising a front panel including a frontal surface facing toward the room, said front panel having a combustion chamber access opening, said housing comprising a bottom wall disposed in spaced apart relationship with said combustion chamber floor to form a lower plenum therebetween;

a transparent door positioned in said front panel access door and openable to access said combustion chamber;

a heat exchanger positioned beneath said combustion chamber floor, said heat exchanger including at least one fan for circulating air therethrough;

duct means for introducing room air into said heat exchanger, said room air introducing duct means comprising at least one inlet opening;

duct means for exhausting warmed room air from said heat exchanger into the room, said warmed air exhausting duct means comprising at least one outlet opening; and means for exhausting air within said lower plenum externally of said fireplace, a room air inlet opening for said lower plenum being horizontally aligned with said at least one inlet opening and said at least one outlet opening and positioned above a bottom edge of said front panel opening;

wherein said at least one inlet opening and said at least one outlet opening are horizontally aligned and positioned above a bottom edge of said front panel opening.

18. A fireplace for combusting fuel comprising:

a combustion chamber whereat the fuel is combusted and products of combustion are created, said combustion chamber comprising an opening through which combustion air is introduced, said combustion chamber further comprising a floor, wherein at least a portion of said floor is raiseable;

a flue positioned for exhausting the products of combustion from said combustion chamber;

a grate for supporting the fuel; and at least one connector connecting said grate and said raiseable floor portion such that application of an upward force to said grate raises said raiseable floor portion.

19. The fireplace of claim 18 wherein said at least one connector comprises a C-shaped bracket shaped to fit over an edge of said raiseable floor portion.

20. The fireplace of claim 18 wherein said fuel grate comprises two rearward legs, and wherein said at least one connector comprises a pair of C-shaped brackets attached to said rearward legs and shaped to fit over a rearward edge of said raiseable floor portion.

21. The fireplace of claim 18 wherein said floor is constructed of refractory material.

* * * * *